United States Patent [19]

Pantone et al.

[11] Patent Number: 4,730,653

[45] Date of Patent: Mar. 15, 1988

[54] LOG SPLITTER

[75] Inventors: Paul Pantone, Garden Valley; Dell W. Bolton, Diamond Springs, both of Calif.

[73] Assignees: Edward L. Scott; Ronald P. Lasher, both of Castleton, N.Y.

[21] Appl. No.: 722,118

[22] Filed: Apr. 11, 1985

[51] Int. Cl.[4] ..... B27L 7/00

[52] U.S. Cl. ..... 144/193 C; 42/106; 89/1.14

[58] Field of Search ..... 144/193 R, 193 C, 193 G; 42/1 R; 89/1.14, 116

[56] References Cited

U.S. PATENT DOCUMENTS

| | | | |
|---|---|---|---|
| 2,132,114 | 10/1938 | Hutchison | 144/193 G |
| 2,966,682 | 1/1961 | Henning | 42/1 R |
| 2,966,683 | 1/1961 | Schulz | 42/1 R |
| 4,350,192 | 9/1982 | Dent | 144/193 C |

*Primary Examiner*—W. D. Bray

*Attorney, Agent, or Firm*—Mark C. Jacobs

[57] ABSTRACT

A log splitter having a wedge placed adjacent an end of the log to be split, a rod fixed to an end of the wedge remote from the log carried within an overlying housing. The rod and wedge are limited in the degree of travel by a bushing and a nailing gun propells the rod and the wedge into the log to be split since the gun is connected to the housing end remote from the wedge.

9 Claims, 4 Drawing Figures

LOG SPLITTER

FIELD OF THE INVENTION

The following invention relates generally to devices for dividing an integral article into a plurality of segments. More particularly, this device relates to log splitters.

BACKGROUND OF THE INVENTION

It is an old saw that firewood heats you twice: when you cut it and when you burn it. Certain difficulties, however, may exist when dividing a log segment into a plurality of wedges so that it can be accepted by a fireplace, woodburning stove or the like. Logs that have knots in them are frequently difficult to split manually, and mechanical advantages gained by hydraulic or electric splitters are expensive. Moreover, these expensive units do not lend themselves to ready portability in the field.

Known prior art devices exist wherein a wedge shaped member is supported on an elongate rod which rod is reciprocally mounted in a sleeve housing dimensioned substantially that of the outer diameter of the rod shaft. The principles of operation for these known prior art techniques rely on the mass of wedge and rod and the acceleration involved in advancing the rod from a retracted position within the associated sleeve to an extended position. In these embodiments, the wedge mean free speed is limited, of course, by the length of travel of the rod within the sleeve, and may be effective only with relatively soft woods, wood that has no knots in it, or rod sleeve lengths that are so long as to be impractical in use.

SUMMARY AND OBJECTS OF THE INVENTION

The primary object of this invention is to provide a device which utilizes a small length of cylindrical tubing within which a rod is supported, the rod having at a distal end a wedge. Coupled with an explosive stimulus, the wedge mean free speed can be substantially enhanced while still providing a relatively short length of travel for the wedge and its associated rod within the cylinder.

A further object of this invention is to provide a device as characterized above which is extremely safe in use and operation. When placed on a conventional explosive nailing gun, the barrel of the nailing gun has to be depressed within the gun barrel housing in order to actuate the explosive charge, commonly a 22 caliber bullet. Analogously, the wedge must be placed with pressure against the log to be split before the gun can be actuated. Thus, safety is assured.

A further object of this invention contemplates providing a device as characterized above which is extremely durable in construction and lends itself to mass production techniques.

It is yet another object of this invention to provide a device as characterized above which has an internal damping system to take into account different densities of wood so that the same explosive charge is extremely unlikely to cause the wedge and associated rod to advance beyond certain design limits which would tend to cause "bottoming out" of a stop member associated with the wedge rod.

A further object of this invention contemplates providing a device as characterized above which is extremely portable and allows itself to be deployed in rough terrain to quickly and expeditiously split wood to facilitate its transport to another location.

A further object of this invention is to provide an improved venting arrangement associated with the wedge rod and its overlying cylinder to offset any effects that may exist with respect to undesireable back pressures and to control the ambient pressure within the cylinder in a prescribed manner.

A further object is to provide a log splitter having a wedge adapted to be placed adjacent the log to be split, a rod fixed to an end of the wedge remote from the log and carried within an overlying housing, an instrumentality for limiting the degree of travel of the rod and wedge beyond the housing, and a gun for propelling the rod and therefore the wedge into the log to be split connected to the housing at an end remote from the wedge.

Another object is to provide the device of the preceeding paragraph with a vent on the housing to control gas buildup therewithin.

Another object is to provide the device of the preceeding paragraph with a stop which includes a piston carried on the rod dimensioned to correspond substantially to an inner bore of the housing and a stop flange at an end of the housing adjacent the wedge with a biasing instrumentality supported within an interior of the housing, overlying the rod and placed between the flange and the piston. In addition, the rod includes a rod of lesser dimension above the piston extending within the gun.

Another object is to provide the device of the preceeding paragraph wherein the biasing instrumentality is embodied as a nylon bushing having a central bore which overlies the lower rod including a plurality of different dimensioned discs integrally formed as the bushing having different outer diameters to provide, in section, a crenelated outer surface with the different dimension discs interleaved. The housing has at an end remote from the wedge a threaded bore adapted to receive complimentally formed threads on a muzzle of the gun and the wedge is embodied as a prismatically configured solid having a top wall, a pair of opposed downwardly extending triangular shaped end walls and a pair of opposed rectangularly side walls meeting at a cutting edge.

Alternatively, the wedge can be embodied as a solid cone having a top wall with a conically depending body member including a ground wedge tip.

These and other objects will be made manifest when considering the following detailed specification when taken in conjunction with the appended drawing figures.

DESCRIPTION OF THE DRAWING FIGURES

BRIEF DESCRIPTION OF THE PREFERRED EMBODIMENT

Figure 1:
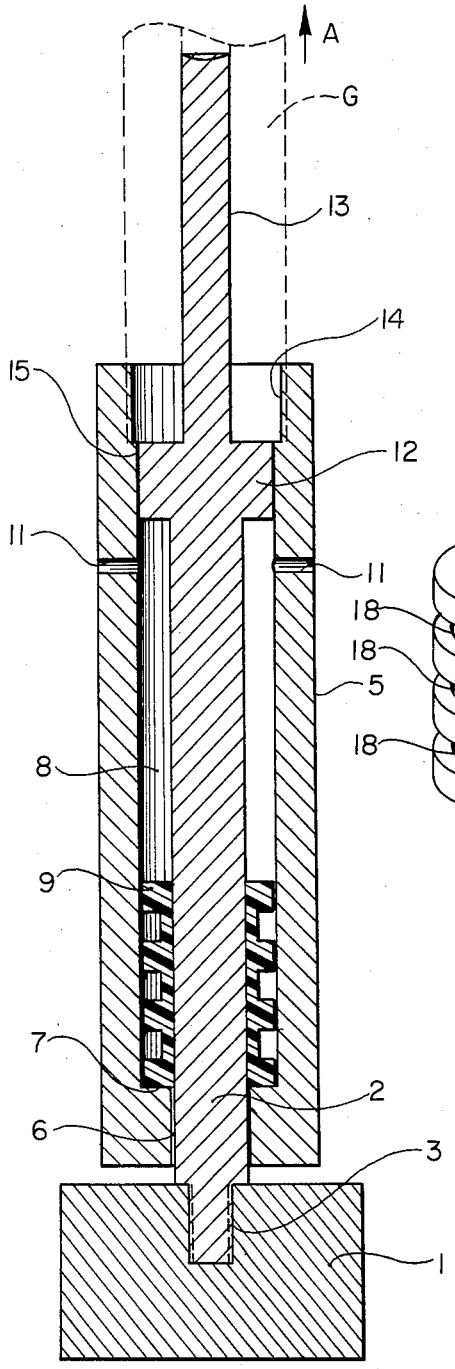
FIG. 1 is a longitudinal sectional view of the apparatus according to the present invention.

Referring to the drawings now, wherein like reference numerals refer to like parts throughout the various drawing figures, reference numeral 10 is directed to the apparatus for segmenting integral articles according to the present invention. In a preferred form, this segmenting device is adapted to be used as a log splitter 10. In its most elemental form, the device is provided with a prismatically configured wedge 1 supported on a rod 2 by having a threaded end 3 of the rod 2 engage a blind bore 4 of the wedge. The bore 4 has threads complimental to the threads on an end of the rod 2.

The rod 2 passes within a housing 5 which in a preferred configuration is cylindrical, with an opening 6 at a lowermost portion of the cylinder allowing access of the rod therethrough. A radially inwardly extending flange 7 defines the opening 6 and the flange 7 emanates from a lowermost portion of the cylinder 5 for purposes to be assigned. By having a flange 7 present, the rod 2 is dimensioned so that it is somewhat less in outer diameter than the inner diameter of the cylinder 5 to provide a toroidal free space 8 within the interior of the cylinder. This provides adequate clearance for the slideable disposition therein of a biasing means 9 which in a preferred form of the invention is an aircraft type nylon compression bushing. Alternatively, a suitably calibrated spring could be used in place of the bushing, but it is believed that the spring has a shorter life span and may be more susceptible than the bushing to larger forces applied against the spring. Thus it is seen that the flange 7 in conjunction with biasing means 9, be it a spring or bushing as described above, and the piston in combination serve as a means for limiting the degree of travel of said rod and the wedge attached thereto. This is accomplished when the gun G is fired, by the impacting of the piston against the biasing means, whose travel is restricted by the presence of the flange.

An upper portion of the cylinder 5 has a pair of vent holes 11 which, when the wedge is in its retracted position, lie below a piston 12 formed on the wedge rod 2. The piston 12 has an outer diameter fairly close to the inner diameter of the cylinder 5, with perhaps 1/32" clearance so that reciprocation of the piston 12 along the longitudinal axis of the cylinder 5 may cause a minor buildup of air pressure in the void 8, which pressure is restrictively released through the vent holes 11, up to a certain point. Once the piston 12 is below the vent holes 11, the vent holes allow retraction of the wedge and rod to its at rest state without any problems associated with air pressure pockets.

The uppermost end of the rod 2 above the piston 12 has a further upper rod 13 of a lesser cross sectional dimension than the lower rod 2, the upper rod 13 adapted to reciprocate within the conventional nail firing gun freely. The gun itself is threaded to a topmost portion of the cylinder 5, the gun G shown in phantom having an outer thread provided at its muzzle complimental with an internal thread 14 on the cylinder 5. It is to be noted that an annular shelf 15 is provided to serve as a stop when threading the gun muzzle into the cylinder 5, which also serves as the uppermost position for the piston 12.

Figure 2:
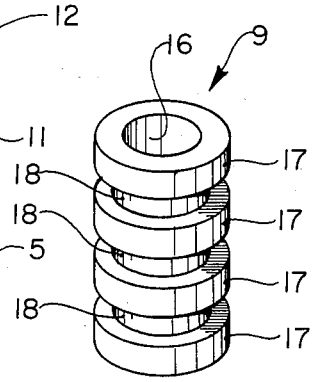
FIG. 2 is a perspective view of one form of damper associated with the present invention.

As shown in FIG. 2, the biasing means 9 is formed as a cylindrical bushing having a central axial bore 16. In a preferred form the outer periphery of the bushing is formed from alternately differently dimensioned disc shaped sections, which as shown in FIG. 2 has four larger diameter sections 18 and three smaller diameter sections 17 interleaved so that when shown in the section of FIG. 1 provides a crenelated outer surface.

Figure 3:
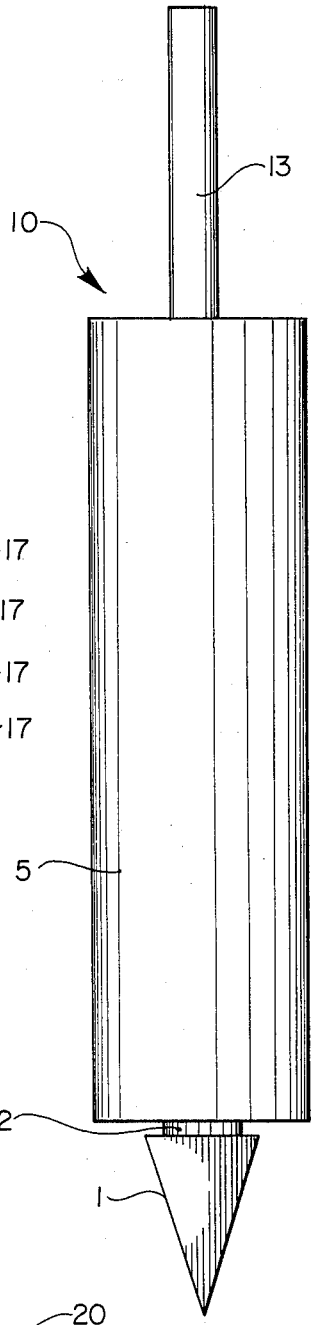
FIG. 3 is a side view of that which is shown in FIG. 1.
Figure 4:
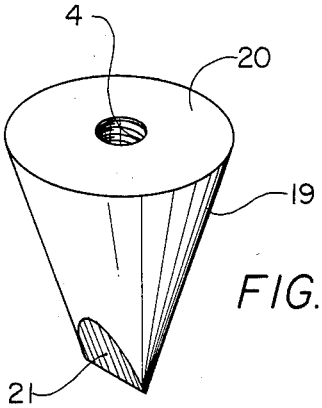
FIG. 4 is a perspective view of an alternatively configured wedge from that which is shown in FIGS. 1 and 3.

FIG. 4 shows an alternative embodiment of the wedge shown in FIGS. 1 and 3. In this embodiment, the wedge 19 is of substantially conical configuration, having a flat top wall 20 with a threaded bore 4. Tip 21 of the wedge is ground to form a wedge shaped lower surface. In this manner, the translation from a vertical force through the conical wedge to a radially extending force upon impact with the log increases the force applied on the log to facilitate splitting.

In use and operation, the gun G is attached to the log splitter 10, and the wedge 1 is placed on a surface of the log to be split. By applying pressure on the surface of the wood through the wedge, the gun barrel is moved in the direction of the arrow A which sets the gun to a position where it is capable of firing. Discharge of the explosive causes rapid acceleration of the rod 13 and therefore the wedge with respect to the cylinder 5 so that the log is easily split. Different densities of wood are accounted for by the bushing 9, and the flange 7 provides the requisite stop and support for the bushing and the forces applied thereagainst. Gases coming from the gun muzzle are vented through the vents 11 on the return of the piston 12 so that no adverse back pressure is experienced. While a gun is the most obvious propulsion applying device, any device that can be secured to the rod and which can cause a rapid acceleration of the rod may be utilized.

Having thus described the invention, it should be apparent that numerous structural modifications are contemplated as being a part of this invention as set forth hereinabove and as defined hereinbelow by the claims.

What is claimed is:

1. A log splitter comprising in combination:

a. a wedge means adapted to be placed adjacent the log to be split, b. a rod means fixed to an end of said wedge means remote from the log and carried within an overlying housing means having an inner bore stop means for limiting the degree of travel of said rod means and wedge means beyond said housing means, c. and means for propelling said rod means, and therefore said wedge means, into the log to be split, connected to said housing means at an end remote from said wedge means, including vent means on said housing means, and wherein said stop means includes a piston carried on said rod means, said piston being dimensioned to correspond substantially to the inner bore of said housing means, said housing means further including a stop flange at an end of said housing means adjacent said wedge means.

2. The device of claim 1 wherein said limiting means includes a biasing means supported within an interior of said housing, surrounding said rod means and placed between said top flange and said piston.

3. The device of claim 2 wherein said rod means includes a rod of lesser dimension above said piston means extending within the gun.

4. The device of claim 3 wherein said biasing means is embodied as a nylon bushing having a central bore which circumscribes said rod means including a plurality of discs integrally formed as said bushing having different outer diameters to provide in section a crenelated outer surface, said different dimensions being interleaved.

5. The device of claim 4 wherein said housing means has at an end remote from said wedge means a threaded bore.

6. The device of claim 5 wherein said wedge means is embodied as a prismatically configured solid having a top wall, a pair of opposed downwardly extending triangular shaped end walls and a pair of opposed rectangular side walls, all side and end walls meeting at a cutting edge.

7. The device of claim 5 wherein said wedge means is embodied as a solid cone having a top wall, a conical tapering side wall terminating in a wedge tip.

8. An apparatus for dissociating an integrally formed article into a plurality of segments comprising in combination:

a wedge means adapted to be placed adjacent the article to be segmented, and means for propelling said wedge means into the article to be segmented to transfer explosive force reciprocally to said wedge means, said propelling means comprising a gun.

9. A propulsive device for splitting logs comprising in combination:

(a) means for transferring the force of a propulsion applying device to a log to be split comprising:

a wedge means adapted to be placed adjacent the log to be split, a rod means fixed to an end of said wedge means remote from the log, and carried within an overlying housing means, means for limiting the degree of travel of said rod means and wedge means from without the said housing means, means for dampening the travel of said rod means when reaching the travel limit, and means for securing to said rod means, at the end remote from said wedge, a device adapted to propel said wedge into the log to be split; and (b) a means adapted to apply a propulsive force to said (a) means for transferring the force wherein the means adapted to apply a propulsive force is a gun.

* * * * *